United States Patent [19]

Nygren

[11] 4,235,305

[45] Nov. 25, 1980

[54] SYSTEM FOR INSPECTING REINFORCING CABLES

[75] Inventor: Gunnar Nygren, Skellefteå, Sweden

[73] Assignee: Linden-Alimak AB, Skellefteå, Sweden

[21] Appl. No.: 6,014

[22] Filed: Jan. 24, 1979

Related U.S. Application Data

[63] Continuation of Ser. No. 773,494, Mar. 2, 1977, abandoned.

[51] Int. Cl.[2] ..... E04G 3/16

[52] U.S. Cl. ..... 182/82; 182/148; 182/187; 187/6

[58] Field of Search ..... 182/82, 141, 148, 142, 182/187, 36, 37, 38, 45, 2; 187/6, 8, 2

[56] References Cited

U.S. PATENT DOCUMENTS

| | | | |
|---|---|---|---|
| 2,231,560 | 2/1941 | Campion | 182/45 |
| 2,647,675 | 8/1953 | Bernett | 187/6 |
| 3,016,989 | 1/1962 | Lindmark | 182/82 |
| 3,141,521 | 7/1964 | Read et al. | 182/82 |
| 3,672,471 | 6/1972 | Badding | 182/141 |
| 3,757,897 | 9/1973 | Moulson | 187/6 |
| 3,830,338 | 8/1974 | Svensson | 182/82 |
| 3,946,836 | 3/1976 | Maack | 182/141 |

*Primary Examiner*—Reinaldo P. Machado

[57] ABSTRACT

Rails are mounted on the wall of a domelike reactor tank along pilasters extending downwardly from the top of the dome. A carriage is drivably mounted on the rails along each pilaster. The carriages each comprise drive means, and a working and inspecting platform. The platform is pivotally mounted and means are provided to control the setting of the platform so that it is always kept horizontal, irrespective of the slope of the rails.

The carriage comprises a main frame in which two sub-frames are pivotally mounted one after the other, on pivot means extending transversally of the direction of motion of the carriage. Two wheel units, or boggie frames, are pivotally mounted in each sub-frame, one on each side of said pivot means. Each boggie frame is carried by wheels engaging the rail means.

17 Claims, 9 Drawing Figures

FIG. 3
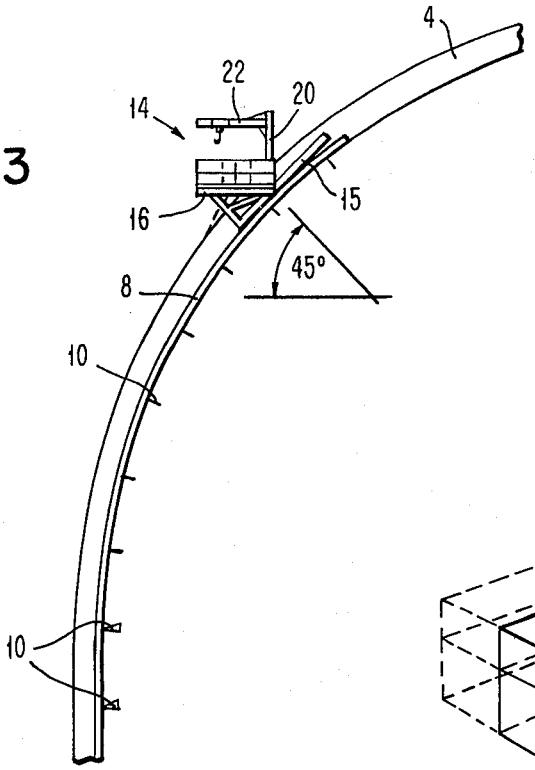
FIG. 9
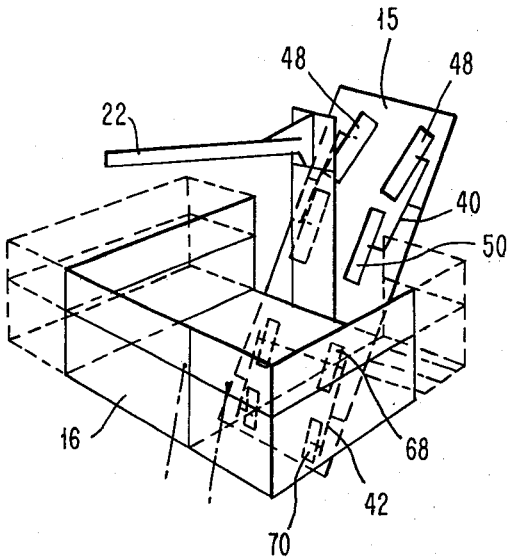
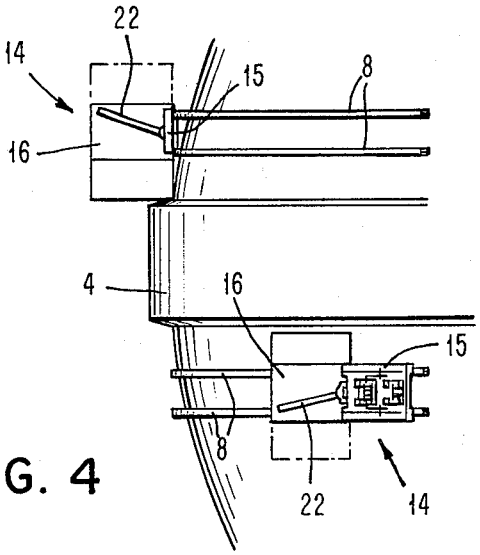
FIG. 4

SYSTEM FOR INSPECTING REINFORCING CABLES

This is a continuation, of application Ser. No. 773,494 filed Mar. 2, 1977 now abandoned.

The present invention relates to a system for installing stressing, inspecting and post-tensioning reinforcing cables, so-called hoop tendons, extending in tubes in the walls of a dome.

For certain purposes, such as reactor tanks for nuclear reactors, buildings comprising a dome are used. Pilasters, or buttresses, extend downwardly from the top of the dome at equal intervals around the circumference thereof. Usually three pilasters, thus mutually separated by an angle of 120°, are used. For reinforcing purposes steel cables extend in the walls of the dome both from the top downwardly and cirumferentially. The first kind of cables in fact are anchored with both ends in or near the ground. The circumferentially extending cables are anchored in the pilasters. In the case of domes using three pilasters the cables thus usually extend over an angle of either 120° or 240°.

After the cables have been installed and tensioned, by means of jacks, they need to be inspected regularly with respect to the need for post-tensioning. This causes no problems as regards the cables extending over the top, since the work can be done with ground based equipment. The circumferential cables, however, which extend on different levels between the top and the ground, cause problems as regards how to perform the stressing and inspecting work most easily and economically.

One object of the invention is to provide a system for installing, tensioning, inspecting and post-tensioning the circumferential reinforcing cables of the kind described.

In one embodiment of the invention rails are mounted on the wall of the dome along each side of the each pilaster. A carriage is drivably mounted on the rails of each side of each pilaster. The carriages each comprise drive means, and a working and inspecting platform. The platform is pivotally mounted and means are provided to control the setting of the platform so that it is always kept horizontal irrespective of the slope of the rails.

In accordance with a preferred embodiment the carriage comprises a main frame in which two sub-frames are pivotally mounted one after the other, on pivot means extending transversally of the direction of motion of the carriage. Two wheel units, or boggie frames, are pivotally mounted in each sub-frame, one on each side of said pivot means. Each boggie frame is carried by wheels engaging the rail means.

Further aspects and advantages of the invention will be described more closely below with reference to the accompanying drawings.

FIG. 3 is a schematical sideview of platform installation drivably mounted on rails on the wall of a dome;

FIG. 4 is a view of the same installation as in FIG. 3 as seen from above;

Figure 5:
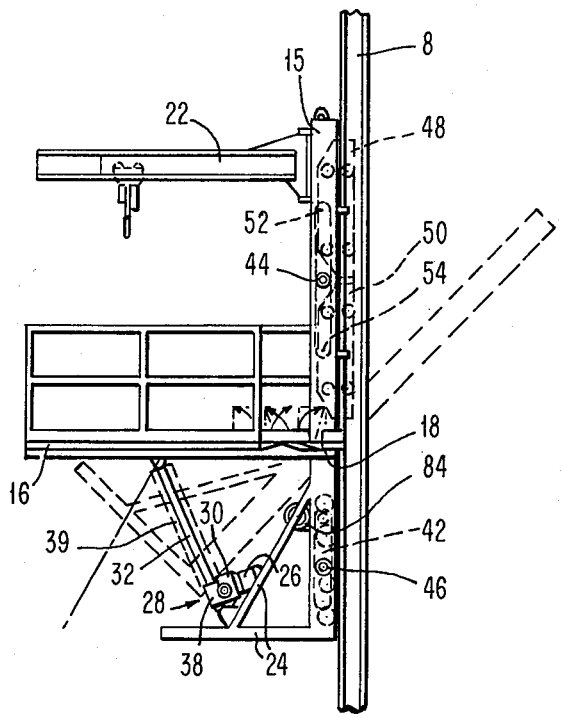
FIG. 5 is a side view in larger scale of the platforms of FIGS. 3 and 4.
Figure 6:
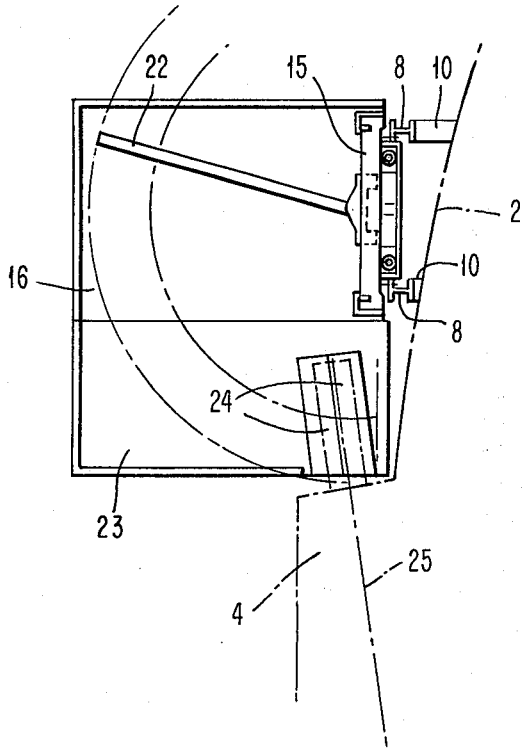
FIG. 6 is a view of the installation according to FIG. 5 as seen from above.
Figure 7:
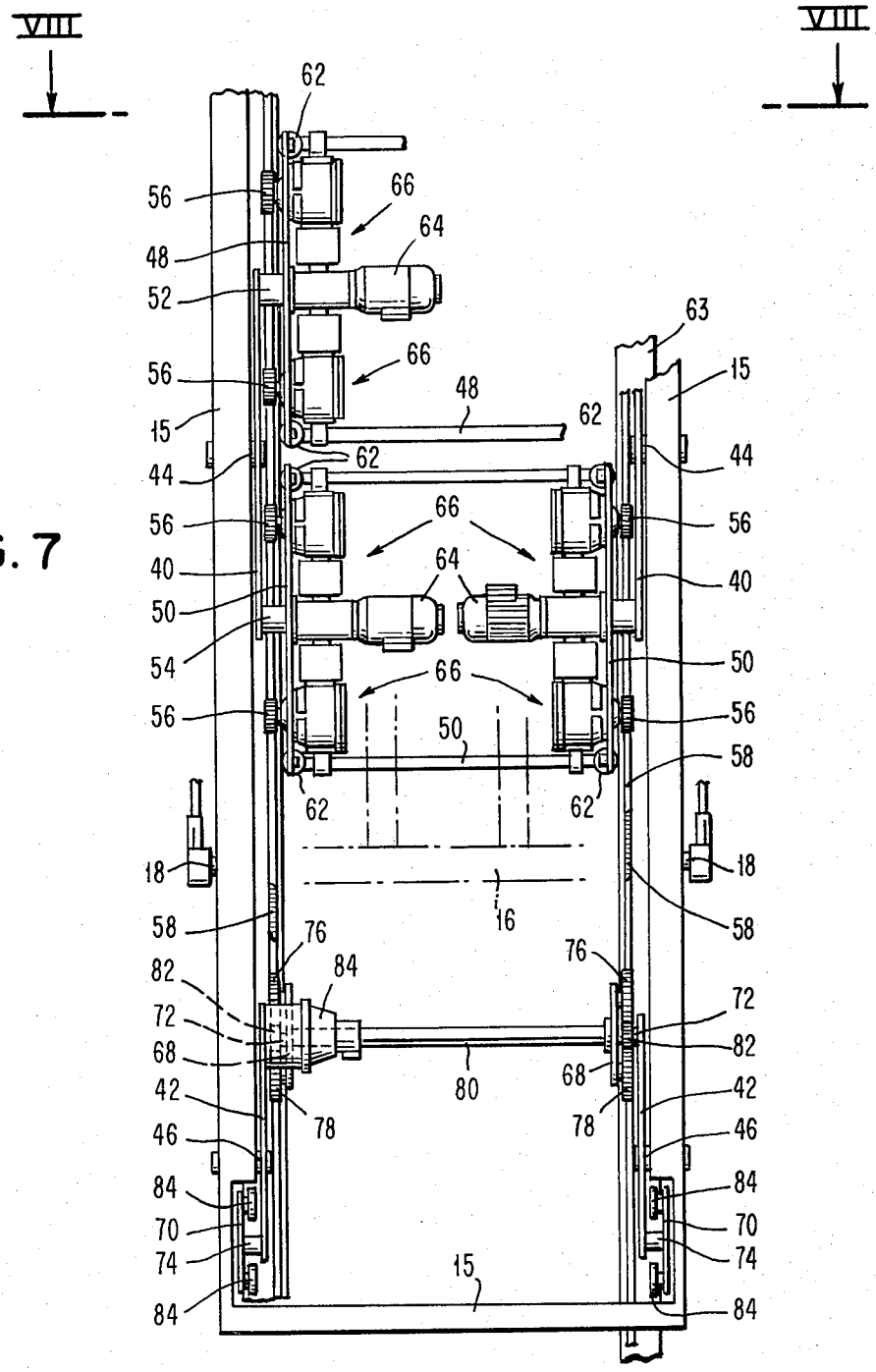
Figure 8:
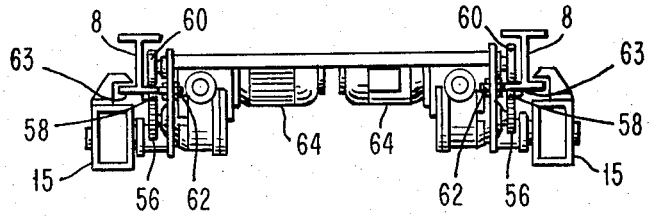

FIG. 7 in still larger scale illustrates details of the installation of FIGS. 5 and 6 as seen in the direction of arrows VII—VII in FIG. 5;

FIG. 8 is a view in the direction of arrows VIII—VIII in FIG. 7;

FIG. 9 in a small scale schematically illustrates the mutual relationship between the parts of the installation according to the invention when taking a position on the wall of the dome.

Figure 1:
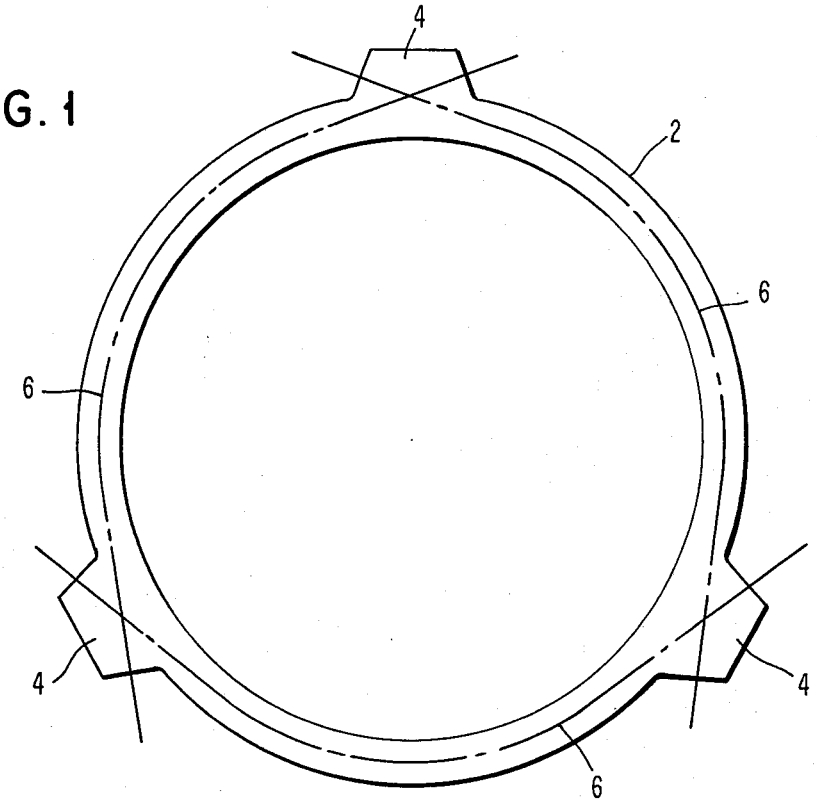
FIGS. 1 and 2 are schematical horizontal sections of a dome to illustrate the extension of reinforcing cables, or hoop tendons, in the walls of the dome.
Figure 2:
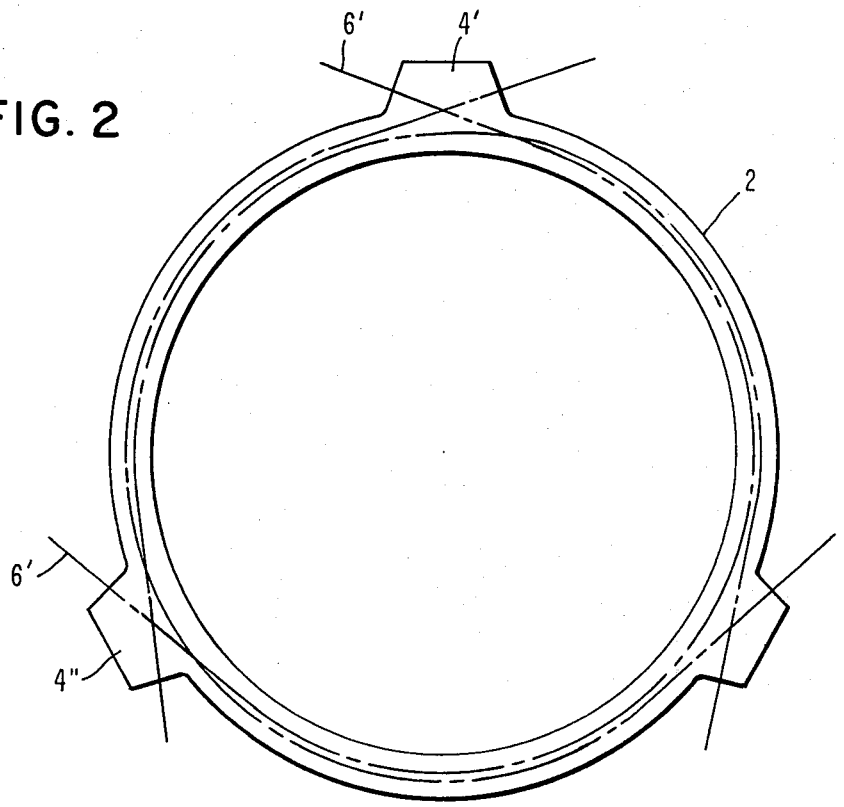

FIGS. 1 and 2 are similar horizontal sections through the walls of a dome-like nuclear reactor tank. The tank wall 2 is made from steel with a concrete lining on each side and includes, in the embodiment shown, three pilasters, or buttresses, 4 integral with the outer concrete lining. The pilasters 4 are equally distributed along the circumference of the dome, mutually enclosing an angle of 120°. On different levels between ground and the 45° above horizontal level of the dome circumferential reinforcing cables 6 extend in tubes cast into the outer concrete lining, but not shown on the drawings. The reinforcing cables 6 are tensioned, by means of jacks not shown, between the pilasters 4 and anchored adjacent their ends in said pilasters. In FIG. 1 each cable 6 is thus anchored in adjacent ones of the pilasters, whereas in FIG. 2 the reinforcing cables, such as cable 6' extend over an angle of 240° while being anchored in pilasters 4' and 4''.

On the walls of the dome, such as the one indicated in FIG. 1 or FIG. 2, I-beams 8 are mounted on brackets indicated at 10 in FIG. 6. More specifically the I-beams 8 are mounted parallel to each other in two pairs, one on each side of each pilaster 2 as shown in FIG. 4. The I-beams extend from ground level to just above 45° up the dome proper (the dome is located on top of a cylindrical lower part).

On each pair of I-beams, or rails 8, a platform equipment, generally denoted 14 in FIGS. 3 and 4, is drivably mounted in a manner to be described in detail below. Each unit 14 comprises a generally rectangular main frame 15. A platform 16 is pivotally mounted on pivots 18 at each side of the main frame. A pillar 20 mounted on the platform 16 carries a beam 22 for a crane carriage indicated with broken lines and intended to lift on board heavy equipment on the platform.

The platform 16 includes a sidewardly offset portion 23 extending close to the pilaster 4. The platform portion 23 has a generally rectangular scuttle 24 the longitudinal dimension of which extends substantially perpendicularly to the nearest side of the pilaster. Via the scuttle 24, when it is opened, it is readily possible to obtain access to the end portion of a reinforcing cable, indicated by broken lines 25, having said end portion anchored in the pilaster.

At its lower end the main frame 15 carriers a bracket 24. On the bracket 24 an electric motor 26 is mounted, and coupled to a worm pinion 28 via a gear 30. The worm pinion includes a screw 32 pivotally mounted at its upper end on a pivot 34 at the underside of the platform 16. The screw 32 is screwed into a rotatable nut 36 which is pivotally mounted at 38 in the bracket 24. The nut 36 is driven by the motor 26 via the gear 30. The motor 26 is controlled by a plumbline indicator, not shown. The plumbline indicator starts the motor to drive the nut 36 as soon as the position of the platform 16 tends to deviate from the horizontal. The plumbline indicator and elements 26, 30 and 36 can be of a kind well known to the man of the art and need therefore not be described more closely here. At 39 a bellows-like covering for the screw 32 is indicated.

In the main frame 15 two sub-frames 40 and 42 are pivotally mounted on pivots 44 and 46, respectively.

At each end of the sub-frame 40 wheel unit or boggie frames 48 and 50 are pivotally mounted on pivots 52 and 54, respectively. The boggie frames 48 and 50 each carry four toothed wheels 56. More specifically, there are two wheels 56 on each side of the boggie frame, engaging a pin rack 58 mounted on the upper flange of each I-beam 8 as shown in FIG. 8. Each boggie frame furthermore carries four guide and support wheels 60 in rolling engagement with the opposite side of said flange of the I-beam. Each wheel 60 is located exactly opposite a corresponding one of the toothed wheels 56 as indicated in FIG. 5. Each one of the boggie frames 48 and 50 furthermore carries four idle wheels 62 in rolling contact while the edge of the rack carrying flange 63 of the I-beam.

Two electric motors 64 each are furthermore centrally mounted in the respective boggie frames as illustrated in FIGS. 7 and 8. Each motor 64 drives the two toothed wheels 56 located on the same side of the boggie frame via each of the gear transmissions generally indicated at 66. The transmissions 66 between the motor 64 and the wheels 56 can be conventional and need therefore not be described more closely here.

The sub-frame 42 likewise carries two boggie frames 68 and 70 pivotally mounted on pivots 72 and 74, respectively, in the sub-frame 42. The upper one 68 of the boggie frames on each side carries two toothed wheels 76 and 78 engaging the rack 58. A shaft 80 extending across the boggie frame carries at each end a toothed wheel 82 engaging between the wheels 76 and 78 on each side. On the left side as seen in FIG. 9 the wheels 76, 78 and 82 make part of a safety centrifugal catching device of the kind described in e.g. Swedish Patent Specification No. 308 785. This device has been generally indicated at 84 in FIG. 9 and need not be described more closely here since it is disclosed in great detail in the abovementioned patent specification. The lower boggie frame 70 just carries two idle wheels 84 on each side, in rolling contact with the rack carrying flange 63 of the corresponding rail 8.

FIG. 9, in a perspective view, very schematically illustrates the mutual arrangement of the details described above and shown on the preceding Figures, as the main frame 15 takes a position corresponding to that shown in FIG. 3.

The equipment described above is used for all kinds of work on cable 6 ending at its side of a pilaster 4. The equipment is thus used in pairs to tension and post-tension the cables 6. Thus, e.g. with reference to FIG. 2, the platforms located at the side of the pilasters 4' and 4'' where the cable ends 6' are, are used as working platforms for tensioning said cable between them. During tensioning the adjacent pilaster serves as a support or holding-up member. The tensioning process does not form part of the invention and will therefore be very briefly described here. Thus, the cable ends are mounted in end blocks seated on the corresponding side of a pilaster. For tensioning, a hydraulic jack is used to lift said end block from its seat whereupon inserts are introduced between the end block and its seat. The crane carriage described earlier is used for lifting the tensioning jack.

For installing purposes the cable guide tubes are orginally cast into the wall of the dome while each containing a thin "pilot" cable. The "pilot" cable is connected end to end with a corresponding reinforcing cable and is used for drawing the reinforcing cable through the tube. Thereupon the reinforcing cable ends are provided with said end blocks and the cable is tensioned.

Finally, it should be noted that the circumferential cables are located very densely, at 60 cm intervals, all the way up to the 45° level. The system according to the invention is therefore very useful for its purpose, and calculations show that it is far more economical and flexible then the top mounted hoisting equipment used earlier.

What is claimed is:

1. In association with a building comprising, a dome, pilasters extending downwardly from the top of said dome, tubes extending circumferentially in the wall of said dome, reinforcing cables extending in said tubes, and anchoring means for said cables in connection with at least some of said pilasters;

a system for installing, tensioning, inspecting and post-tensioning said cables, comprising rail means mounted on the wall of said dome along each side of each pilaster having connection with said anchoring means, carriage means carried by and drivable on said rail means on each side of each pilaster, each carriage comprising, mounted thereon, drive means, working and inspecting platform means, and means for pivotally mounting said platform means on said carriage means to maintain said platform means in a horizontal position.

2. A system according to claim 1, wherein each carriage means comprises a main frame carrying said platform means and said pivotally mounting means, at least two sub-frames pivotally mounted one after the other in said main frame on first pivot means extending transversally of the direction of motion of said carriage, two boggie frames pivotally mounted in each sub-frame, one on each side of said first pivot means, each boggie frame being carried by wheels engaging said rail means and carrying said drive means.

3. A system according to claim 2, wherein said rail means comprises two parallel beams each carrying a rack, said wheels including driven toothed wheels in engagement with said racks.

4. A system according to claim 2, wherein the wheels of each of the two boggie frames of one sub-frame include two pairs of toothed wheels engaging respectively each rack.

5. A system according to claim 2, wherein each boggie frame carries two drive motors, each of which is coupled via two gear units for driving the two wheels, respectively, of each one pair.

6. A system according to claim 2, wherein the first one of the half frames carries said driven wheels and the second one of said half frames carries a security catching device.

7. A lift arrangement, comprising upwardly extending rail and rack means, carriage means carried by and drivable on said rail and rack means and comprising, mounted thereon, drive means, platform means, and means for pivotally mounting said platform means on said carriage means to maintain said platform means in a horizontal position, said carriage means further comprising a main frame carrying said platform means and said pivotally mounting means, at least two sub-frames pivotally mounted one after the other in said main frame on first pivot means extending transversally of the direction of motion of said carriage, two boggie frames pivotally mounted in each sub-frame, one on each side of said first pivot means; each boggie frame being carried by wheels engaging said rail and rack means.

8. An arrangement according to claim 7, wherein said rail and rack means comprises two parallel beams each carrying a rack, said wheels including driven toothed wheels in engagement with said racks.

9. An arrangement according to claim 8, wherein the wheels of each of the two boggie frames of one sub-frame include two pairs of toothed wheels engaging respectively each rack.

10. An arrangement according to claim 7, wherein the boggie frames of one sub-frame each carry two drive motors, each of which is coupled via two gear units for driving the two wheels, respectively, of each one pair.

11. An arrangement according to claim 8, wherein the first one of the half frames carries said driven wheels and the second one of said half frames carries a security catching device.

12. A lift arrangement as claimed in claim 7 wherein said pivotally mounting means comprises pivot means pivotally connecting said platform means to said carriage means, screw and nut means including a screw portion and nut portion and pivotally supporting said platform means with respect to said carriage means by means of opposite end pivots remote from said pivot means and respectively connected with said screw and nut portions, and motor drive means for rotating said nut portion.

13. An arrangement according to claim 11 wherein said security catching device comprises toothed wheels of one of the boggie frames of said second half frame.

14. In association with a building suitable as a nuclear containment structure comprising, a dome, buttresses extending downwardly from the top of said dome, said dome including tubular openings extending circumferentially and substantially horizontally in the walls thereof, reinforcing tendons extending through said tubular openings, anchoring means for said tendons in connection with at least some of said buttresses;

a system for installing, tensioning, inspecting and post-tensioning said tendons comprising rail means mounted on the wall of said dome along each buttress having connection with said anchoring means, said rail means comprising two parallel rails each carrying a gear rack, carriage means carried by and drivable on said rail means;

each carriage means comprising toothed gear wheel-sengagement with said racks, drive means coupled to drive at least some of said gear wheels, working and inspecting platform means, and means for pivotally mounting said platform means on said carriage means to maintain said platform means in a horizontal position as said carriage means travels up and down said rail means.

15. A system as claimed in claim 14 wherein said carriage means includes a security catching device coupled to at least some of said gear wheels.

16. A system as claimed in claim 14 or claim 15 wherein said rail means comprises two pairs of rails arranged along each buttress with one pair at each side of each buttress and with a separate carriage means carried by each pair of rails.

17. The combination as claimed in claim 14 wherein said pivotally mounting means comprises pivot means pivotally connecting said platform means to said carriage means, screw and nut means including a screw portion and nut portion and pivotally supporting said platform means with respect to said carriage means by means of opposite end pivots remote from said pivot means and respectively connected with said screw and nut portions, and motor drive means for rotating said nut portion.

* * * * *